US006491163B1

(12) United States Patent
Grcic et al.

(10) Patent No.: US 6,491,163 B1
(45) Date of Patent: Dec. 10, 2002

(54) RE-USER CASE

(75) Inventors: Elvira E. Grcic, Carmel, NY (US); Ronald E. Zajac, Hopewell Jct., NY (US)

(73) Assignee: Windings, Inc., Patterson, NY (US)

( * ) Notice: Subject to any disclaimer, the term of this patent is extended or adjusted under 35 U.S.C. 154(b) by 0 days.

(21) Appl. No.: 09/891,215

(22) Filed: Jun. 26, 2001

(51) Int. Cl.[7] ..... B65D 85/672
(52) U.S. Cl. ..... 206/403; 206/409; 242/163
(58) Field of Search ..... 206/403, 405, 206/409, 415; 242/163, 171, 170

(56) References Cited

U.S. PATENT DOCUMENTS 4,057,203 A * 11/1977 Newman et al. ..... 242/137.1
4,160,533 A * 7/1979 Kotzur et al. ..... 206/397
5,053,795 A * 10/1991 Wyman ..... 206/409
5,115,995 A * 5/1992 Hunt ..... 242/137.1
5,593,035 A * 1/1997 Taylor et al. ..... 206/397
5,714,936 A * 2/1998 Regelsberger ..... 206/409
5,810,272 A * 9/1998 Wallace et al. ..... 242/137.1
5,979,812 A * 11/1999 Kotzur et al. ..... 206/409
6,109,554 A * 8/2000 Kotzur et al. ..... 242/137.1
6,145,722 A * 11/2000 Behrens et al. ..... 206/403

* cited by examiner

*Primary Examiner*—David T. Fidei
(74) *Attorney, Agent, or Firm*—R. J. Lasker, Esq.

(57) ABSTRACT

A Re-user case for retaining a wound coil of filamentary material wherein first and second separate half-sections, each including mating projections and counterpart receptacles enabling the two sections to be releaseably joined and forming an enclosed case containing the wound coil and wherein the first and second half-sections are formed of injection molded impact resistant high intensity propylene; each of the half-sections including releasable locking members to join the first and second half-sections to one another to form the Re-user case; and the Re-user case including large and small diameter payout openings respectively accommodating a first payout tube for unwinding a coil of filamentary material or large diameter and a second payout tube for unwinding a coil of filamentary material of small diameter.

22 Claims, 5 Drawing Sheets

105
25a 106
30a 107
31a 108
27a 80
83
88a
87a
89a
17
10
11
94
98
36a
99
85
95
90a
102
103
93a
91a
92a
31a
24
30a
12
9
40a
39a
28a
44
27a
43
13
16
25a
38
33a
14
90b
91b
92b
93b
15
29b
32a
96
86
82
97
100
88b
101
29a
35a
87b
89b
84
115
110
114

111

112

113

RE-USER CASE

BACKGROUND OF THE INVENTION

1. Field of the Invention

This invention relates to re-usable cases for containing a package of wound electrical wire or cable for unwinding through a payout hole and payout tube and, more particularly, to such cases that are injection molded of impact- resistant, high density polyethylene in complementary attachable sections to provide two different sized ports for related sized payout tubes for paying out different sized electrical wire or cable and wherein the two-sections afford ease of insertion and removal of electrical wire or cable. The two sections are easily and readily attachable to form a contained re-user case with built in support feet enabling the re-user case to be set down at the work site and further including built in handles for easy portability of the re-user case.

2. Related Art

1.) U.S. Pat. No. 4,160,533; Kotzur et al.; "Container with Octagonal Insert and Corner Payout"; and assigned to the same assignee as the present application: A package of filamentary material wound in a figure-8 configuration with a radial hole extending from the central core space thereof to the outer periphery thereof is enclosed in a container having a perforated corner portion for unwinding the FM material. The winding is placed within a polygonally-sided insert having opposing sides engaging the outer periphery of the windings and including a payout tube inserted in the radial hole for feeding the inner end of the material. Opposite sides of the insert engage the inner surfaces of the container with the payout tube being aligned with the perforated corner portion. The bottom and upper surfaces of the container include intersecting cone sections for supporting the inner windings of the material.

2.) U.S. Pat. No. 5,979,812; Kotzur et al.; "Coil with Large Payout Hole and Tube for Kinkless Payout"; and assigned to the same assignee as the present application: A paper or corrugated container is disclosed having a hingeable panel including an opening and a payout tube formed of container-type material and with an outer end opening conforming to the panel opening. A flap member extends from each of the openings and extends through and around the edges of the panel opening for supporting the payout tube with the panel in a closed position.

3.) U.S. Pat. No. 6,109,554; Kotzur et al.; "Combined Fiber Containers and Payout Tubes and Plastic Payout Tubes"; and assigned to the same assignee as the present application: A combined container and payout tube is shown in FIG. 10A wherein the container holds a wound coil of filamentary material and includes a payout hole extending from the inner coil to the outer coil. A serrated opening in a panel of the container is opened to allow the filamentary material to be removed from the container. The filamentary material is threaded through a payout tube incorporated as part of the container. The container is dimensioned in accordance with the diameter of the wound coil that is to be contained therein; and 4.) "The Reelex Re-User"; Advertisement of Windings circa 1990: A blow molded re-user container of impact resistant high density polyethylene for holding wound coils of electrical wire or cable which includes two identical half-sections each containing a cone extending from the center of the section into the central opening of the wound coil to maintain the shape of the coil and to limit movement thereof inside the re-user container. The re-user container is weather proof, portable (light weight) and affords the usual REELEX benefits, namely, non rotating spool, low tension and non-twist wind affording easy payout, no over-run and less scrap.

SUMMARY OF THE INVENTION

The Re-User cases of the invention are an improvement over that of the Reelex Re-User container described above (paragraph 4) and are constructed for containing wound electrical coils and cables for unwinding. The Re-User cases of the invention are injection molded of impact resistant high density polyethylene to improve the cost of manufacture. as opposed to a blow molding process used with the prior art Reelex Re-User Cases.

Additionally, the REELEX Re-User cases of the present invention do not utilize cones or the like to stabilize the wound coil.

Moreover, the two half-sections of the Re-User cases of the present invention use combined hinge and clamps to open and close the separate case sections and to secure each half-section to one other thereby enclosing the wound electrical wire or cable.

The Re-User case of the present invention accommodates new tube designs such as the EZ Tube and the Reelex II Tube.

The Re-User case of the present invention accommodates storage and payout of large diameter cable such as CAT 5, CAT 6, CAT 7 electrical cable through a large diameter payout tube and "normal-sized" electrical wire or cable through a smaller diameter payout tube. The payout tube for the large diameter electrical wire or cable is, for example, defined in U.S. Pat. Nos. #5,979,812 and #6,109,554 (referred to above) and the payout tube for "normal-sized" electrical wire or cable is defined, for example, in U.S. Pat. No. #4,022,399; Zajac; "Screw-In Tube with Breakable Tabs for Coil of Flexible Material with Inner End Payout"; U.S. Pat. No. #4,057,203; Newsman et al.; "Package of Flexible Material with Oval Payout Tube"; and U.S. Pat. No. #5,810,272; Wallace et al.; "Snap-On Tube and Locking Collar for Guiding Filamentary Material Through a Wall Panel of a Container Containing Wound Filamentary Material" (all of the aforementioned patents being assigned to the same assignee as the present application, namely Windings,. Inc.).

Finally, the Re-User case of the present invention is designed to be weatherproof, sturdy, stackable, re-usable, portable and provide the usual benefits of the REELEX wind, i.e. non rotating spool, low tension and non-twist wind affording easy payout, no over-run and less scrap.

It is a primary object of the invention to provide a Re-User case for wound electrical coils or cable that is made of injection molded, impact-resistant, high density polyethylene.

It is a feature of the invention that the Re-User cases are light in weight.

It is an advantage of the invention that the Re-User cases are portable.

A further object of the invention is that the separate half-sections of the Re-User case are removably joined to one another to form the closed Re-User case.

A further feature of the invention is that the separate half-sections are clamped to one another by removable, plastic clamps.

A further advantage of the invention is that the clamped sections of the Re-User case are easily closed and opened by a simple rotation of the various clamps to engage preformed retaining members on opposing sections of the case.

Another object, feature and advantage of the invention is that the Re-User cases are optimally configured to be stored one on top of the other to reduce space.

Yet another object of the invention is to provide a lower cost of manufacture than known Re-User cases.

Yet another feature of the invention is that the Re-User cases are made of injection molded polyethylene.

Yet another advantage of the invention is that the Re-User cases are durable and of high strength to withstand the rough and hard usage to which they are exposed in the field of their application.

Yet another object of the invention is to provide safe storage and kinkless, twistless payout of a wide diameter/size of wound, electrical wire or cable from a re-usable container made of light weight, durable material.

Yet another feature is that the Re-User case of the invention can easily be converted to store and payout either large or small diameter/size electrical cable or wire through either one of two different-sized payout tube openings.

Yet another advantage of the invention is that each Re-User case of the invention can store and payout a wide range of diameter of electrical wire or cable from the same Re-User case.

DETAILED DESCRIPTION OF THE INVENTION

Figure 1:
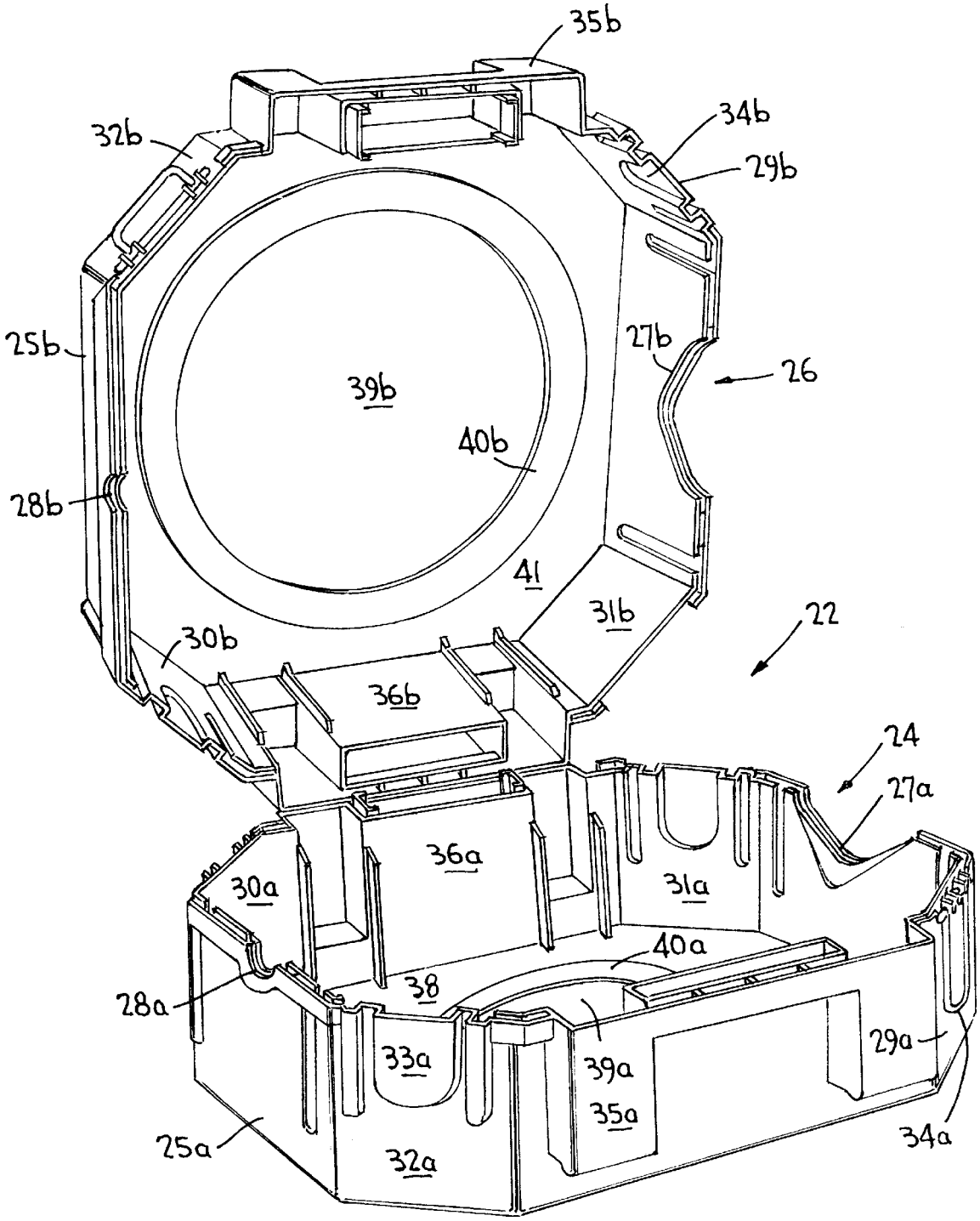
FIG. 1 is a pictorial, perspective view of the symmetrical lower and upper halves of the Re-User case according to the invention; however, in the preferred embodiment of the invention the two halves of the Re-User case are not hinged as the Fig. merely depicts the symmetrical structure of the upper and lower halves of the Re-User case.
Figure 2:
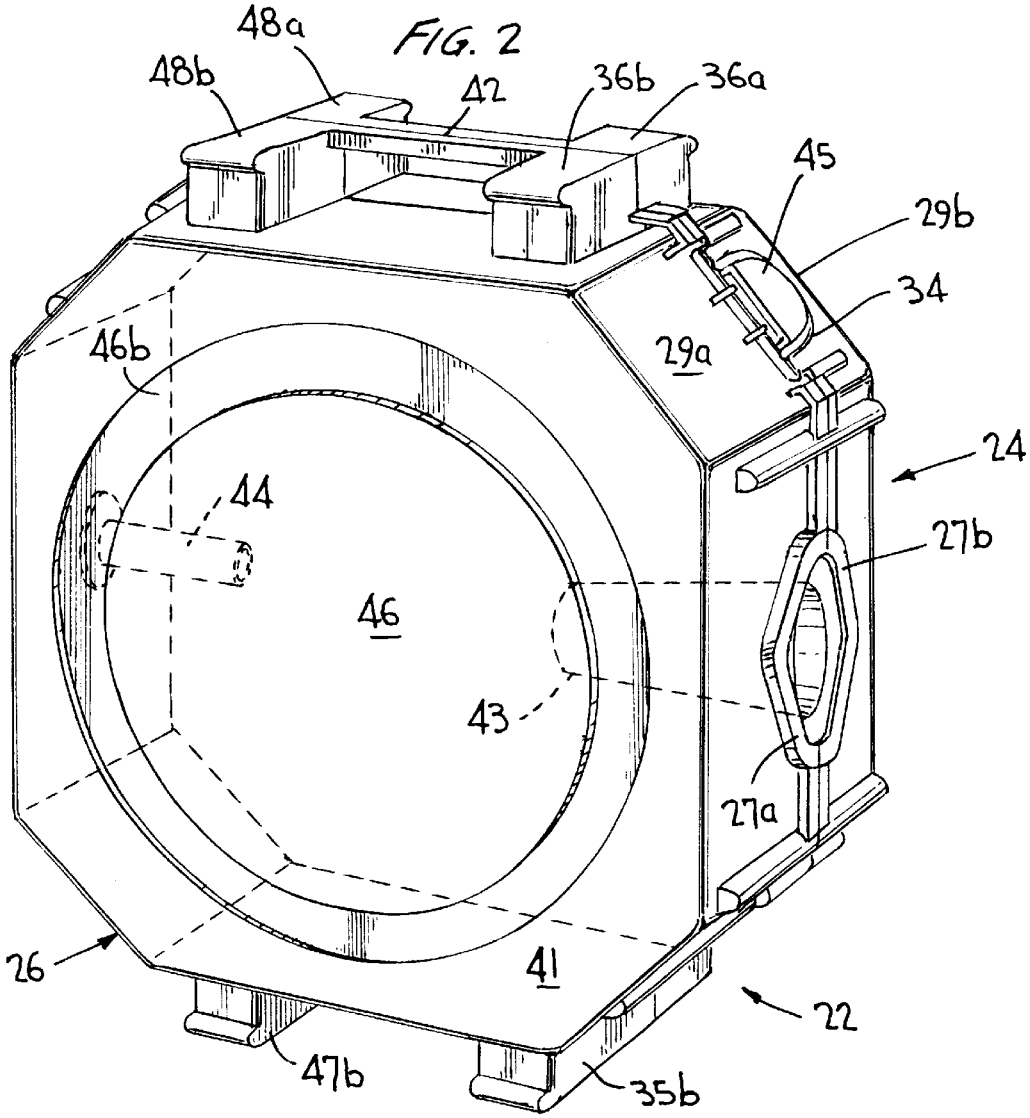
FIG. 2 is a perspective view of the Re-User container with the lower and upper halves closed and showing the provision of a large payout tube for the payout of large diameter cable such as CAT5, CAT6 and CAT7 cable and a smaller payout tube for the payout of smaller diameter wire or cable.

The re-user case 1 is divided into two symmetrical sections, namely a lower section 24 and an upper section 26 as illustrated in FIG. 1. It should be noted at the outset that each half section of the Re-User case is made in a suitable injection mold apparatus and as such is a unitary continuous structure requiring no fastening means whatsoever. As will be apparent from the following description, each of sections 24 and 26 are symmetrical and are adapted to be joined when the two sections are closed and attached to one another as shown in FIG. 2. Wall member 25*a* of the lower half 24 of the Re-User case 22 includes one-half of a large radius cutout 27*a* for accommodating a large diameter payout tube (see FIGS. 8 and 19) and a small opening 28*a* for accommodating a small diameter payout tube (see FIGS. 8 and 18). Wall member 25*a* includes opposing wall sections 29*a*, 30*a* and 31*a*, 32*a* each of which include clip retaining structures 33*a* that will be more fully described hereinafter with respect to FIGS. 4–7, and which coact with a respective clip 34*a* (more fully described hereafter with respect to FIGS. 4–7 and 20) to secure lower halves 24 and 26 together with a wound coil oor wire in the Re-User case 22.

Wall sections 35*a* and 36*a* each form one-half of a handle/foot (to be more fully described with respect to FIGS. 2 and 8) enabling the Re-User case to be easily hand-carried or placed on a flat surface.

With reference to the upper half 26 of the Re-User case 26 shown in FIG. 1, the common components are identified therein by the suffix "b". Thus wall member 25*b* of the upper half 26 of the Re-User case 22 includes one-half of a large radius cutout 27*b* for accommodating a large diameter payout tube (see FIGS. 8 and 19) and a small opening 28*b* for accommodating a small diameter payout tube (see FIGS. 8 and 18) . When the lower and upper halves are joined, then cutouts 27*a*, 28*b* and 28*a*, 28*b* form respective payout tube openings for receiving respective large and small-sized payout tubes (as illustrated in FIG. 2). Wall member 25*b* includes opposing wall sections 29*b*, 30*b* and 31*b*, 32*b* each of which include clip retaining structures 33*b* that will be more fully described hereinafter with respect to FIGS. 4–7 and which coact with a respective clip 34*b* (more fully described hereafter with respect to FIGS. 4–7 and 20) to secure lower halves 24 and 26 together with a wound coil (not shown) in the Re-User case 22.

Wall sections 35*b* and 36*b* each form one-half of a handle/foot (to be more fully described with respect to FIGS. 2 and 8) enabling the Re-User case to be easily hand-carried or placed on a flat surface.

User case 22 is constructed by injection molding impact-resistant, high density polyethylene in a manner known to those skilled in the art.

Depression 39*a* with circularly-shaped ring 40*a* is formed in the bottom 38 of the lower half 24 of the Re-User case 22 to strengthen the bottom 38 and to provide for a raised external surface for advertising. In a similar manner depression 39*b* with circularly-shaped ring 40*b* is formed in the bottom 41 of the upper half 26 of the Re-User case 22 to strengthen the bottom 41 and to provide for a raised external surface for advertising.

FIG. 2 illustrates the assembled lower 24 and upper 26 halves forming the assembled Re-User case 22. Handle 42 is formed as shown in the Fig. by the mating of wall sections 36*a,* 36*b.* Another handle/foot (not shown) is formed by the mating of wall sections 35*a,* 35*b* (see FIG. 1). Similarly wall section 47*b* mates with another wall section 47*a* (not shown) to form another portion of a handle/foot (not shown) and wall sections 48*a* and 48*b* form the other half of handle/foot 42. The above described wall sections also serve as feet to support the Re-User case as shown in FIG. 2.

Figure 3:
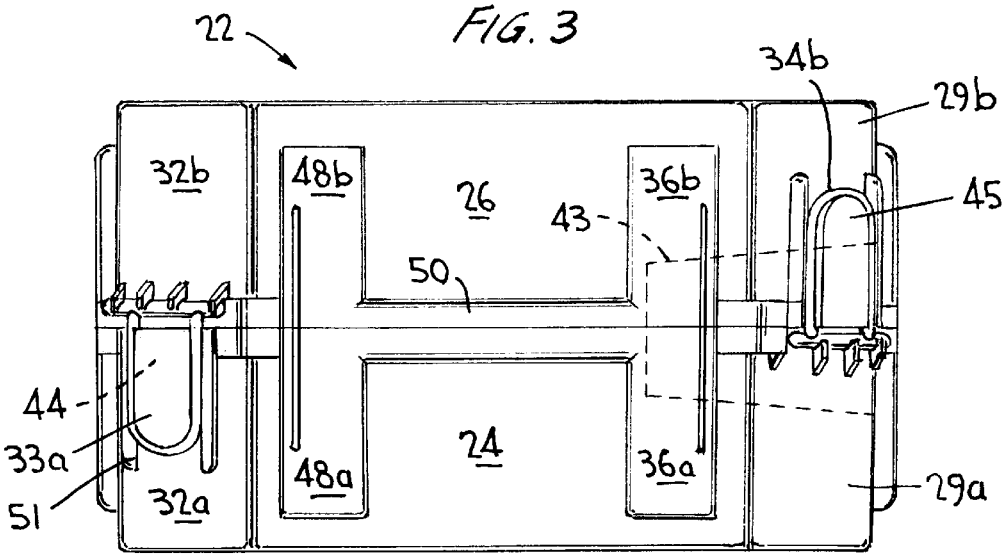
FIG. 3 is a top view of the Re-User case shown in FIG. 2.

With reference to FIGS. 2 and 3, a large diameter payout tube 43 is shown protruding from an opening formed by the mating of cutout sections 27*a,* 27, respectively from the lower and upper halves 24, 26 of the Re-User case. A portion of a small diameter payout tube 44 is shown to the left in FIG. 2. One of four retaining clips 34*a* (only one being shown in FIG. 2) is shown engaging with a preformed retaining member 45 (the structure of the retaining clips and the corresponding retaining members is described more fully hereinafter with respect to FIGS. 4–7).

Raised circumferential portion 46 and depressed circumferential ring 46*b* formed in the top portion 41 of upper half 26 strengthens the top 41 and is also available for advertising.

The handles/feet 47*b* and 35*b* (only a portion of which are shown at the bottom of FIG. 2) serve either as a means for carrying the Re-User case or as a support member for supporting the Rs-User case 22 on the ground or other suitable surface.

The top view of the Re-User case 22 illustrated in FIG. 3, shows the small diameter payout tube 44 protruding from the left side of the Re-User case 22 and the large diameter payout tube 43 extending from the right side of the Re-User case 22. Lower wall sections 29*a* and 32*a* of lower half section 24 mate with counterpart upper wall sections 29b and 32b, respectively, of upper half section 26. In a similar manner lower handle/foot sections 36*a,* 48*a* mate with counterpart upper handle/foot sections 36*b,* 48*b,* respectively to form a handle/foot 50. Handle/foot 50 obviously enables the Re-User case 22 and the wound coil therein (not shown) to be easily hand carried to different locations within a storage area or at a worksite. Retaining clip 51 engages curved retaining member 33*a* in wall section 32*a* to partially secure the lower half section 24 of the Re-User case to upper half section 26. similarly, retaining clip 34*a* engages curved retaining member 45 to partially secure the lower and upper half sections 24, 26 to one another.

Figure 4:
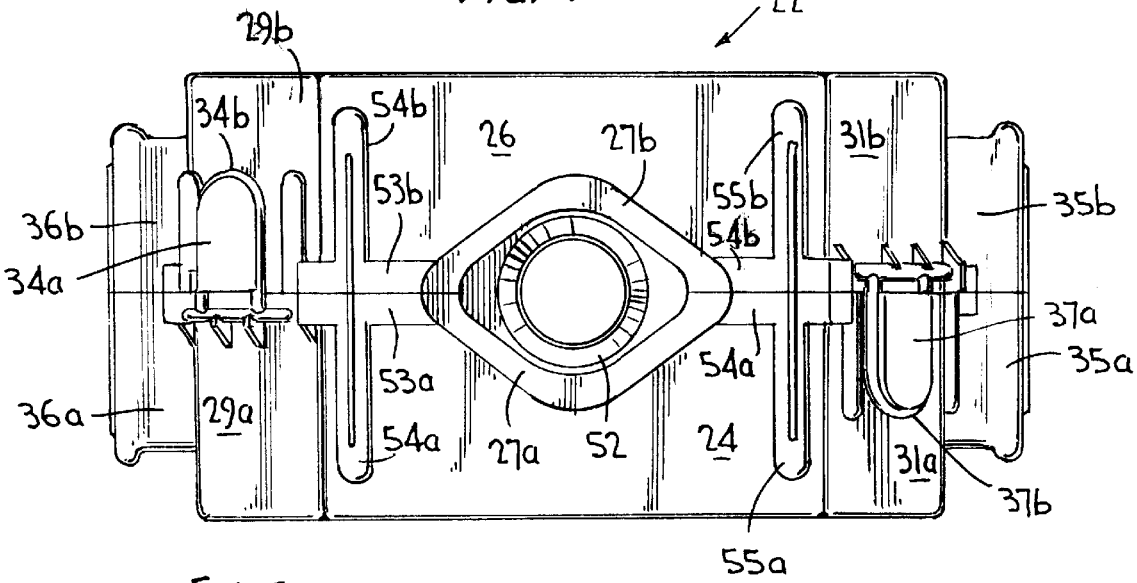
FIG. 4 is a right side elevation of the Re-User case of FIG. 2.

Counterpart retaining clips and curved retaining members are also located at wall sections 31*a,* 31*b* and 30*a,* 30*b* to provide a retaining force at each of the four corners of the reuser case represented by the aforementioned wall sections as shown in FIG. 4.

The side elevation view of the Re-User case 22 in FIG. 4, in addition to the retaining members and clips mentioned previously, shows the mating of cutouts 27*a* and 27*b* to form an opening 52 for accommodating the large diameter payout tube 52. The closure of the lower and upper halves 24, 26 of the Re-User case 22 also joins horizontal members 53*a,* 53*b* and 54*a,*54*b* along with strengthening members 54*a,* 54*b* and 55*a,* 55*b.* Respective handle/foot portions 35*a,* 35*b* and 36*a,* 36*b* are illustrated on the respective right and left sides of the Re-User case 22.

Figure 5:
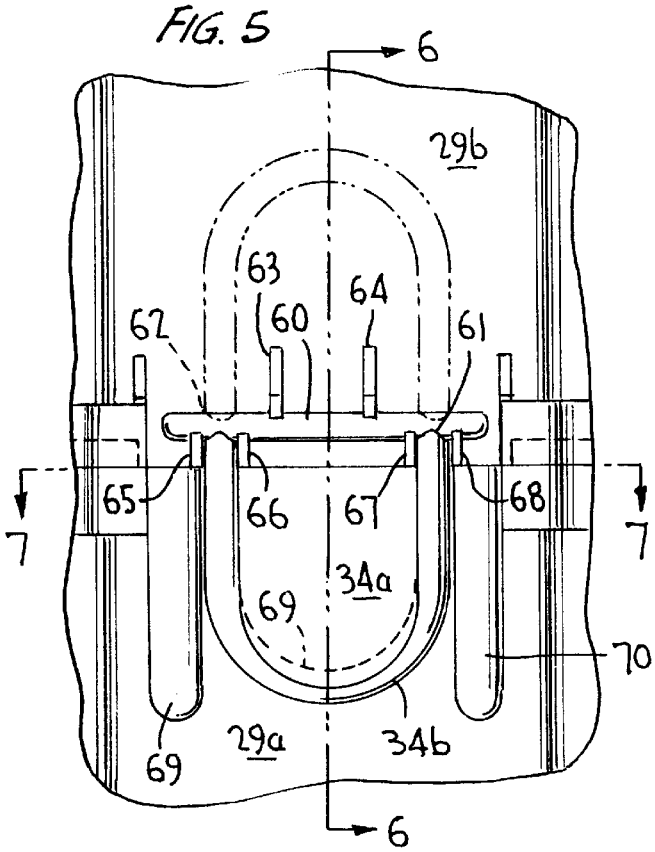
FIG. 5 is a detail view of a plastic clip and retaining member for securing a portion of the upper and lower sections of the Re-User case.
Figure 20:
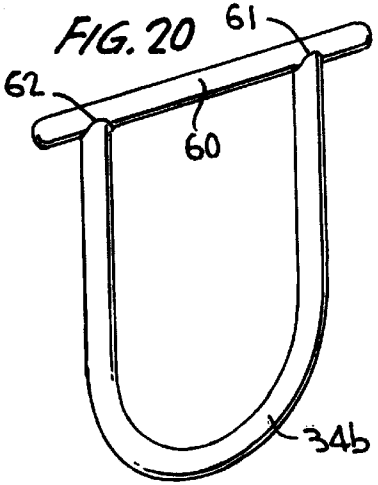
FIG. 20 is a perspective view of a retainer clip for attaching the separate lower and upper halves of the Re-User case.

A detail of the plastic retaining clip and retaining member structure is illustrated in FIGS. 5 and 20, wherein ushaped retaining clip 34*b,* includes connecting member 60 which joins the two ends 61, 62 of the retaining clip. Connecting member 60 is removable secured within a pair of clip members 63, 64 formed on wall member 29 and two pairs of opposing clip members 65, 66 and 67, 68, respectively. U-Shaped clip 34*b* is force fit between clip members 63, 64 and the pair of clip members 65, 66 and 67, 68 so as to rotate from the position shown in phantom lines to the position shown in full lines to engage over the curved retaining structure 69 and thereby secure the lower wall member 29*a* and upper wall member 29*b* of the respective upper and lower sections 24, 26 of the Re-User case.

The clip members 63, 64, 65, 66, 67 and 68 enable the retaining clip member 34*b* to not only rotate as shown in FIG. 5, but also to be removed and separated from the Re-User case 22.

Figure 6:
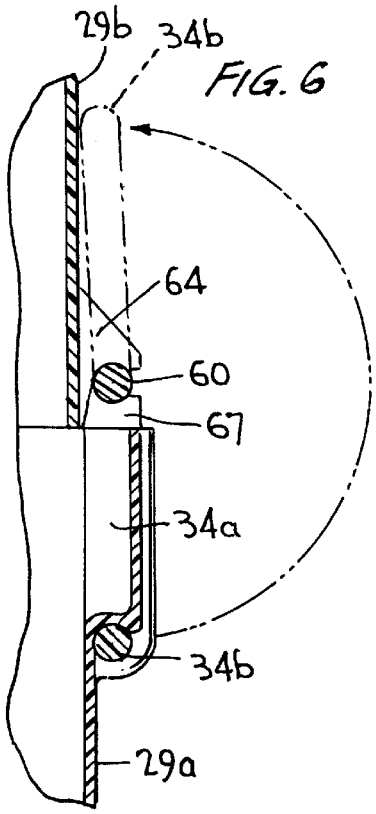
FIG. 6 is a section of the retainer clip and wall of the Re-User case along line 6—6 of FIG. 5.

FIG. 6 shows a section of the retainer clip 34*b* taken along lines 6—6 of FIG. 5 and wherein clip members 64, 67 engage the center portion 60 of clip retainer 34*b* and the curved portion of retaining member 34*a* engages the retaining clip 34*b* in the closed position. In moving between the open and closed position the retainer clip 34*b* travels along the arc illustrated by the arrow in the Figure. In the open position, the center 60 of the retaining clip 34*b* may be disengaged from the retaining clips 64, 67, 63, 64, 65 and 66 to be removed from the Re-User case 22.

Plastic ridges 69, 70, integral with wall section 29*c,* provide support for the Re-User case wall section 29*a.* These ridges are common to all of wall sections 29*a,* 32*a* and 29*b* and 30*b* as is redily apparent from the various Figures.

Figure 7:
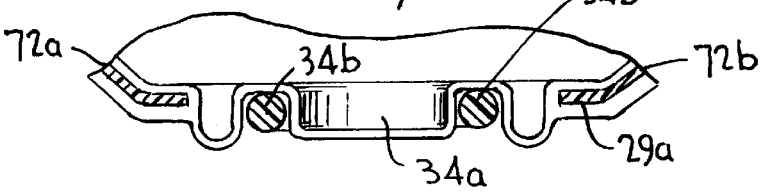
FIG. 7 is a section of the retainer clip and the wall of the Re-User case along lines 7—7 of FIG. 5.

A sectional view of the retainer clip 34*b,* the wall section 29*a* and the section of the retaining member 34*a* are shown in FIG. 7 and illustrates the manner in which the retainer clip 34*b* is retained between the retaining member 34*a* and the support member 69 when in the closed position. Recesses 72*a,* 72*b* in wall section 29*a* of one half section of the Re-User case 22 receive projections (not shown) in the opposing half section of the Re-User case 22 for aiding in securing the two halves together, as will be discussed more fully hereinafter with respect to FIGS. 8–16.

Figures 8, 9, 10, 11, 12, 13, 14, 15, 16:
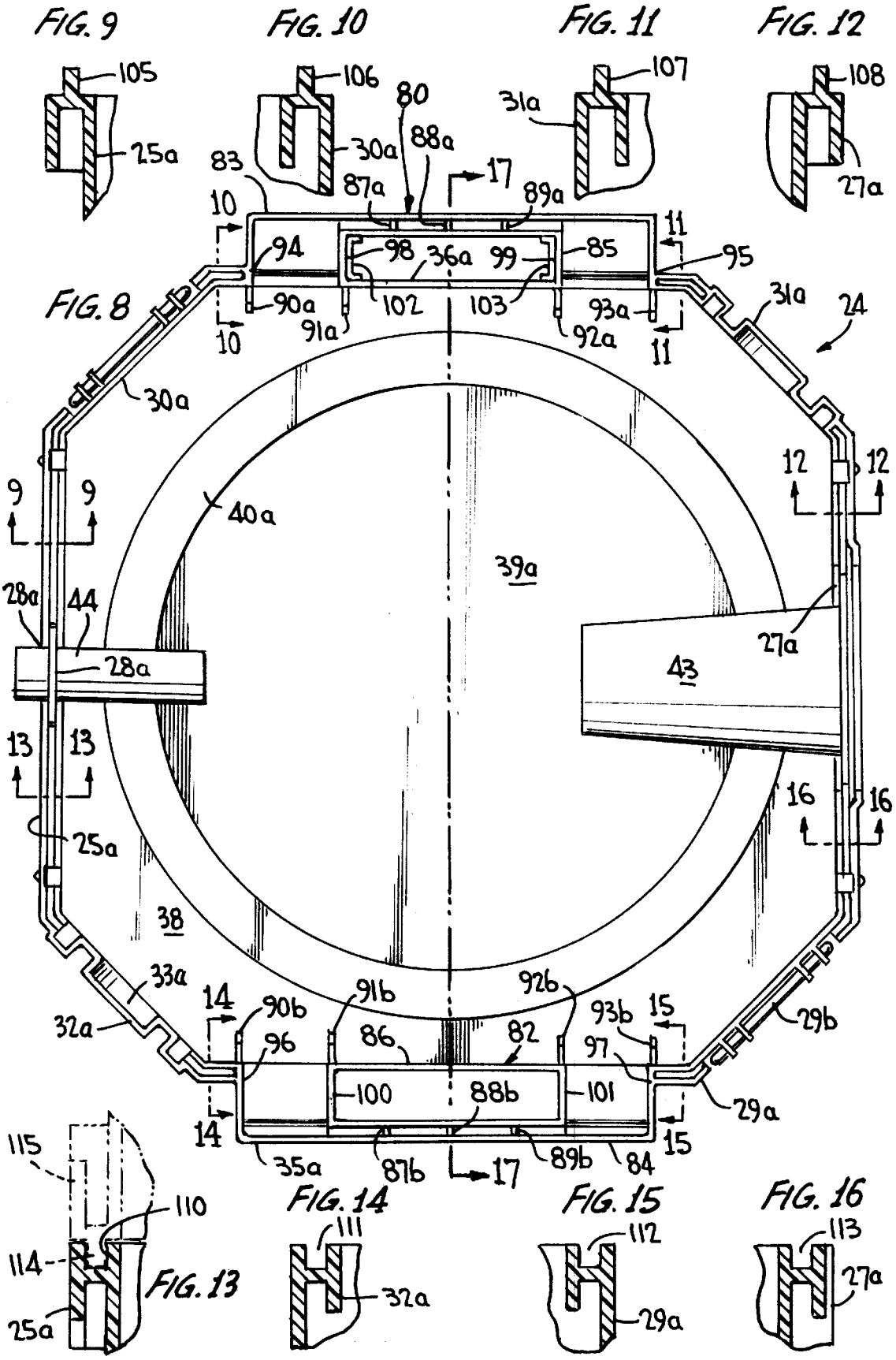
FIG. 8 is a plan view of the lower half of the Re-User case shown in FIG. 1.
FIGS. 9, 10, 11 and 12 are respective cross-sections of the Re-User case wall along lines respective lines 9—9, 10—10, 11—11, 12—12 of FIG. 8.
FIGS. 13, 14, 15 and 16 are respective cross-sections of the Re-User case wall taken along lines 13—13, 14—14, 15—15, 16—16 of FIG. 8.

FIG. 8 is a plan view of the lower half section 24 of the ReUser case 22 shown in FIG. 1 which clearly shows the generally octagonal configuration and the substantial symmetry of the Re-User case structure. Opposing handle/foot sections 80, 82 are identical and each comprise a hollow section, 35*a,* 36*a* having a rectangularly shaped outer member 83, 84 and a corresponding inner frame member 85, 86 of which inner wall sections 36*a* and 35*a* are integral parts. Rib members 87*a,* 88*a* and 89*a* support and strengthen the outer member 83 and the inner frame member 85. Similarly rib members 87*b,* 88*b* and 89*b* support and strengthen the outer member 84 and the inner frame member 86. Inner rib members 90*a* and 93*a* provide respective support for wall member 36*a* and the respective junction 94 and 95 of outer frame member 83 and wall section 30*a* and wall member 36*a.* Similarly, inner rib members 90*b* and 93*b* provide respective support for wall member 35*a* and the respective junction 96 and 97 of outer frame member 84 and wall section 32*a* and wall member 31*a.* Rib members 91*a* and 92*a* reinforce the respective end portions 98 and 99 of inner frame member 85. In like fashion, rib members 91*b* and 92*b* reinforce the respective end portions 100 and 101 of inner frame member 86.

Inner frame member 85 includes a respective upstanding projection 102, 103 at end portions 98 and 99. It is noted that inner frame member 86 does not include any such projections. It is understood that the upper half section 26 (not shown in FIGS. 8–16) is identical to lower half section 24 described in FIGS. 8–16 and that when the two half sections are joined, the upper half section will be rotated so that the upstanding projections of the lower half will engage within the inner frame of the upper half section having no projections and vice-versa. From the following description it will be apparent that the remaining structures of the lower and upper half sections of the Re-User case are similarly constructed so as to be in interlocking relationship when they are joined to one another.

The combination of projections and recesses for joining the lower and upper half sections of the Re-User case is illustrated with respect to the cross sections through various wall sections of the lower half section 24 shown in FIGS. 9–12 and 13–16, respectively. The section through one half of wall section 25*a* supporting the small diameter payout tube 44 (FIG. 9), the section through wall section 30*a* (FIG. 10), the section through wall section 31*a* (FIG. 11) and the section through one half of wall section 27*a* supporting the large diameter payout tube 43 all indicate respective projections 105, 106, 107 and 108 extending from the respective wall sections 25*a,* 30*a,* 31*a* and 27*a.*

Reference to FIGS. 13–16, respectively illustrating sections through the lower half of wall section 25*a* (FIG. 13), wall section 32*a* (FIG. 14), wall section 29*a* (FIG. 15) and the lower half of wall section 27*a* (FIG. 16) clearly indicates the presence of recesses 110, 111, 112 and 113 in the respective wall sections. In FIG. 13, a projection 114 from a counterpart wall section 115 of an upper half section of the Re-User case is shown (in phantom) engaging the recess 110 of wall section 25*a*. In like or similar manner, the various projections and recesses of each half section of the resuser case engage or join one another to enable the two half sections to be assembled together as illustrated in FIG. 2.

Figure 17:
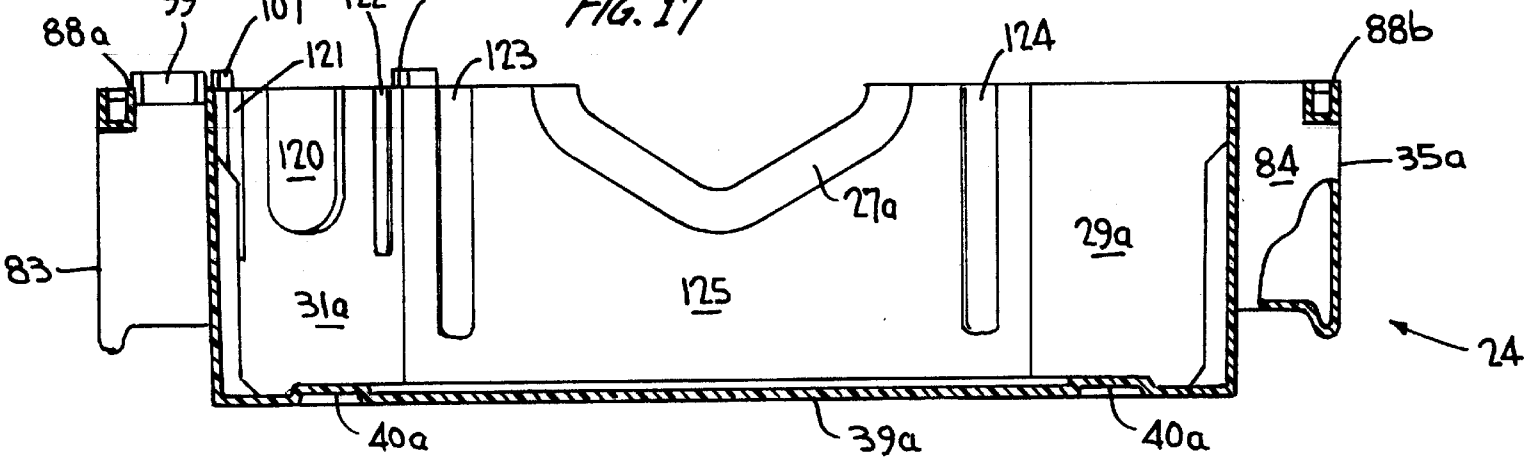
FIG. 17 is a partially broken section of the lower half of the re-suer case taken along lines 17—17 of FIG. 8.

The cross-sectional view of FIG. 17 taken along lines 17—17 of FIG. 8 shows the handle/foot member 83 along with the projection 99 and the supporting rib 88*a* of lower half section 24 of the Re-User case 22. Floor 39*a* is bounded by raised sections 40*a*. Projecting rib 107 extends above wall section 31*a* (FIG. 11) and indentation 121 in the wall section strengthens it in a manner known to those skilled in the art of injection molding. The inside of curved support member 120 will grasp the rounded portion of a retaining clip to help join the upper and lower half sections of the Re-User case. Indentations 122 and 123, 124 serve to strengthen wall sections 31*a* and 125, respectively. Wall section 29*a* adjoins wall sections 125 and 35*a*. Wall section 35*a* includes rib member 88*b* for strengthening handle/foot member 84.

Figure 19:
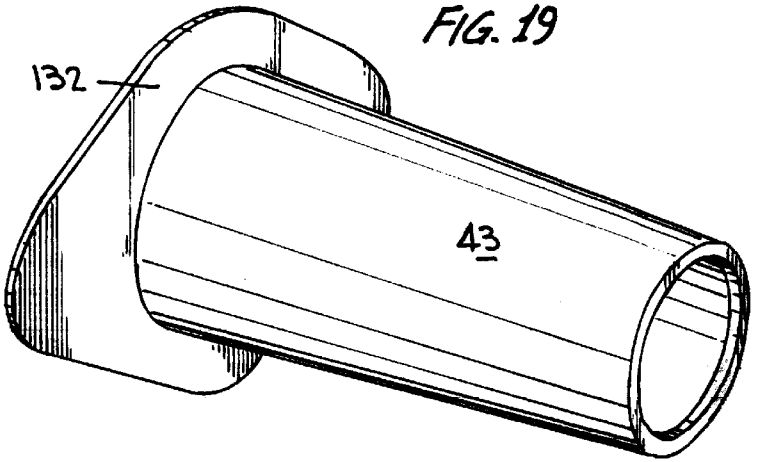
FIG. 19 is a perspective view of a large payout tube for attachment to the Re-User case for paying out large diameter filamentary material.
Figure 18:
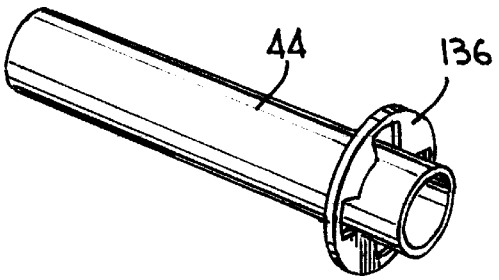
FIG. 18 is a perspective view of a small payout tube for attachment to the re-user case for paying out small diameter filamentary material.

FIGS. 18 and 19 respectively illustrate a small diameter payout tube and a large diameter payout tube. These payout tubes are themselves described in the patents referred to in the Background of the Invention. The payout tubes, in their simplest configuration, simply comprise a plastic material with a flange 130 attached at one and which is received in aperture 28*a* of side wall 25*a* (FIG. 1) to retain the payout tube to prevent its slipping out of the Re-User case and the payout hole in the filamentary material stored in the Re-User case. In a similar manner large diameter payout tube 43 includes a flange 132 that is inserted in aperture 27*a* of wall casing 125 to prevent the payout tube from slipping out of the payout hole in the filamentary material and the Re-User case.

It is of course understood that in the actual operation of the manner in which the flanges of the payout tubes are retained in either apertures 28*a* or 27*a,* that the respective flange of a particular payout tube also is retained within the respective corresponding aperture of the other of the other half section of the Re-User case, thereby affording a complete entrapment of the payout tube within the side opening of the Re-User case.

The above description serves only to describe exemplary embodiments of the best mode of making the present invention and to demonstrate the features and advantages of its construction and operation. The invention is not intended to be limited thereby, as those skilled in the Re-User case art will readily perceive modifications of the above-described embodiments. Thus the invention is intended to be limited only by the following claims and the equivalents to which the claimed components thereof are entitled.

What is claimed is:

1. A Re-user case for retaining a wound coil of filamentary material, comprising:

first and second separate half-sections each including mating projections and counterpart receptacles enabling the two sections to be releasably joined and forming an enclosed case containing the wound coil;

said first and second half-sections being formed of injection molded impact resistant high density propylene;

each of said half-sections including releasable locking members to join said first and second half-sections to one another to form the Re-user case; and the Re-user case including a large diameter payout opening and a small diameter payout opening respectively accommodating a first payout tube for unwinding a coil of filamentary material of large diameter and a second payout tube for unwinding a coil of filamentary material of small diameter.

2. A Re-user case according to claim 1, wherein the joined half-sections further includes a molded section forming at least one combined handle/foot enabling the Re-user case to be hand carried or placed on the ground or floor in an upstanding position.

3. A Re-user case according to claim 1, wherein said releasable locking members include a number of preformed retaining members and a number of rotatable hook members alternately spaced around the periphery of one of said half-sections and an equal number of preformed retaining members and a number of rotatable hooks alternately spaced around the periphery of the other of said half-sections so that the preformed retaining members of one half-section are opposed to the rotatable hooks of the other half-section, thereby enabling engagement of the respective retaining members and the rotatable hooks to join each of the half-sections.

4. A Re-user case according to claim 1, wherein each half-section further includes a patterned section for strengthening the half-section.

5. A Re-user case according to claim 1, wherein each half-section further includes spaced rib members for strengthening the half-section.

6. A Re-user case according to claim 2, wherein each half-section is octagonally shaped, the small and the large diameter openings are oppositely disposed along the periphery of each half section and the at least one molded section forming at least one combined handle/foot is disposed between the small and large diameter openings.

7. A Re-user case according to claim 1, wherein each of said half-sections has a complementary external shape such that Re-user cases can be in stacked relationship.

8. A Re-user case according to claim 2, wherein said releasable locking members include a number of preformed retaining members and a number of rotatable hook members alternately spaced around the periphery of one of said half-sections and an equal number of preformed retaining members and a number of rotatable hooks alternately spaced around the periphery of the other of said half-sections so that the preformed retaining members of one half-section are opposed to the rotatable hooks of the other half-section, thereby enabling engagement of the respective retaining members and the rotatable hooks to join each of the half-sections.

9. A Re-user case according to claim 2, wherein each half-section further includes a patterned section for strengthening the half-section.

10. A Re-user case according to claim 2, wherein each half-section further includes spaced rib members for strengthening the half-section.

11. A Re-user case according to claim 2, wherein each half-section is octagonally shaped, the small and the large diameter openings are oppositely disposed along the periphery of each half section and the at least one molded section forming at least one combined handle/foot is disposed between the small and large diameter openings.

12. A Re-user case according to claim 2, wherein each of said half-sections has a complementary external shape such that Re-user cases can be in stacked relationship.

13. A Re-user case according to claim 3, wherein each half-section further includes a patterned section for strengthening the half-section.

14. A Re-user case according to claim 3, wherein each half-section further includes spaced rib members for strengthening the half-section.

15. A Re-user case according to claim 3, wherein each half-section is octagonally shaped, the small and the large diameter openings are oppositely disposed along the periphery of each half section and the at least one molded section forming at least one combined handle/foot is disposed between the small and large diameter openings.

16. A Re-user case according to claim 3, wherein each of said half-sections has a complementary external shape such that Re-user cases can be in stacked relationship.

17. A Re-user case according to claim 4, wherein each half-section further includes spaced rib members for strengthening the half-section.

18. A Re-user case according to claim 4, wherein each half-section is octagonally shaped, the small and the large diameter openings are oppositely disposed along the periphery of each half section and the at least one molded section forming at least one combined handle/foot is disposed between the small and large diameter openings.

19. A Re-user case according to claim 4, wherein each of said half-sections has a complementary external shape such that Re-user cases can be in stacked relationship.

20. A Re-user case according to claim 5, wherein each half-section is octagonally shaped, the small and the large diameter openings are oppositely disposed along the periphery of each half section and the at least one molded section forming at least one combined handle/foot is disposed between the small and large diameter openings.

21. A Re-user case according to claim 5, wherein each of said half-sections has a complementary external shape such that Re-user cases can be in stacked relationship.

22. A Re-user case according to claim 6, wherein each of said half-sections has a complementary external shape such that Re-user cases can be in stacked relationship.

* * * * *